United States Patent [19]

Tamura et al.

[11] 4,131,213

[45] Dec. 26, 1978

[54] MAGAZINE VENDING MACHINE

[76] Inventors: Yoshihiro Tamura, No. 9, Fukuchiin-cho, Nara-shi, Nara-ken; Takeshi Togashi, 22-5, Aza Kamenoko, Oaza Dogata, Turuoka-shi, Yamagata-ken, both of Japan

[21] Appl. No.: 740,751

[22] Filed: Nov. 10, 1976

[51] Int. Cl.[2] ..... G07F 11/20

[52] U.S. Cl. ..... 221/14; 133/4 R; 221/125; 221/155

[58] Field of Search ..... 221/6, 14, 103, 155, 221/130, 125, 241; 133/2, 4 R, 4 A, 5 R

[56] References Cited

U.S. PATENT DOCUMENTS

| | | | |
|---|---|---|---|
| 2,273,814 | 2/1942 | Bartel et al. | 221/130 |
| 2,576,636 | 11/1951 | Opgenorth | 221/40 |
| 2,681,842 | 6/1954 | Rabkin et al. | 221/125 |
| 2,724,391 | 11/1955 | Fremon | 133/4 R |
| 2,816,688 | 12/1957 | Wolf | 221/6 |
| 3,114,475 | 12/1963 | Etes | 221/103 |
| 3,708,087 | 1/1973 | Schonthal | 221/155 X |

FOREIGN PATENT DOCUMENTS

| | | | |
|---|---|---|---|
| 1935455 | 1/1971 | Fed. Rep. of Germany | 221/125 |

*Primary Examiner*—Allen N. Knowles
*Assistant Examiner*—Francis J. Bartuska
*Attorney, Agent, or Firm*—Browdy and Neimark

[57] ABSTRACT

A magazine vending machine which is operable solely by manually activated lever mechanisms and without any electric devices. The machine is further characterized in that sample magazines displayed at a show-window are utilizable for sale by lever mechanisms which are automatically operable when the corresponding magazines other than the samples which are stocked for sale in the machine are exhausted.

2 Claims, 20 Drawing Figures

FIG. 8
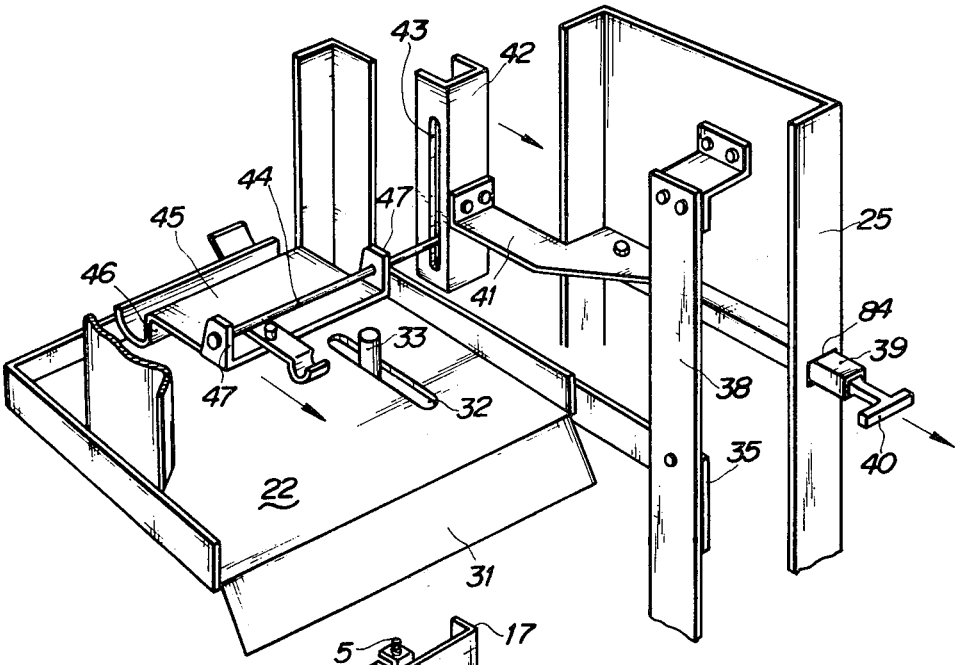
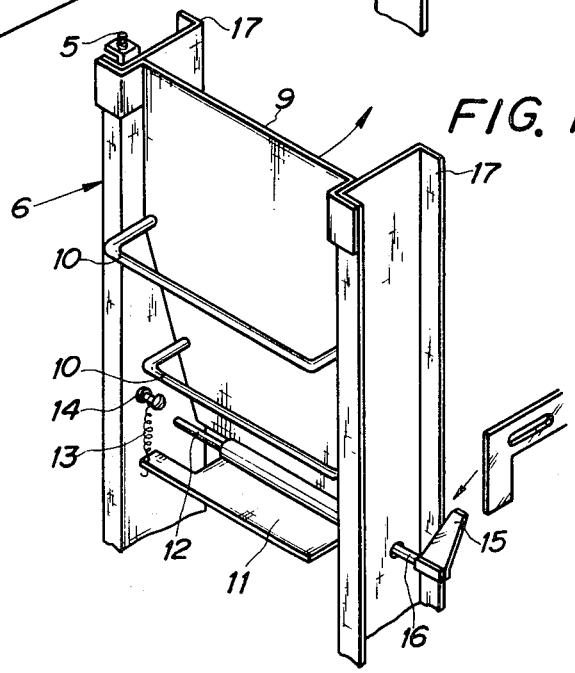
FIG. 11

MAGAZINE VENDING MACHINE

This invention relates to a magazine vending machine.

Conventional machines of this kind are most generally operated by electric devices. Such electric devices are so complicated that they often break, resulting in the malfunction of the vending machines, and they are inoperative when the electric current stops. Their installation are inherently limited only to the sites where electric sources are obtainable. An additional drawback accompanied to the conventional machines is that they are expensive on account of complicated electric devices by which they operate.

Therefore, it is a principal object of this invention to provide a magazine vending machine which is operable solely by manual powers and without any electric device, and in which magazines and changes are releasable or backed by manual drawing strength.

Another characteristic structure of conventional machines of this kind is such that as their outer housings are made as constituents of some parts which are accommodated within the housings, they can hardly be assembled at the sites where they are installed but they have to be transported to the sites as completely assembled.

Hence, it is a secondary object of this invention to provide a magazine vending machine having such overall structures that outer housings and those parts which are to be accommodated are independently made each other, and they can readily be assembled at sites one desires.

It is noticed in conventional machines of this kind that they have at their front sides show-windows which display one each of magazines on sale as samples. Those samples stand solely for the purpose of display, and they are to be left unsold.

Therefore, it is another object of this invention to provide a magazine vending machine in which those magazines which are displayed at show-windows are also made available for sale.

In conventional vending machines of the aforementioned kind, it is further noticed as their disadvantageous points that through there are provided at their front sides drawing levers of a number corresponding to the number of magazines displayed at show-windows, purchasers opt to operate a wrong lever, and can not obtain a magazine they desire to have, because the levers are located remotely to sample magazines and because they are not located distinctly to each other.

Hence, it is further another object of this invention to provide a magazine vending machine of the kind aforementioned which are provided with such levers consumers can readily distinguish each other with reference to a magazine they wish to buy.

Still further, it is noticed in conventional magazine vending machines that locking mechanisms employed in the machines for the prevention of withdrawal of more than one levers at a time are so complicated that the manufacture thereof is laboured and expensive.

Therefore, it is still further another object of this invention to provide a magazine vending machine which has comparatively simple mechanisms for preventing the withdrawal of magazines of several kinds at a single operation.

Further features, objects and advantages of this invention will become apparent with reference to the following description and drawings wherein:

FIG. 8 is a perspective view of lever mechanisms for releasing a magazine;

FIG. 11 is a perspective view of shelves for sample magazines;

Figure 1:
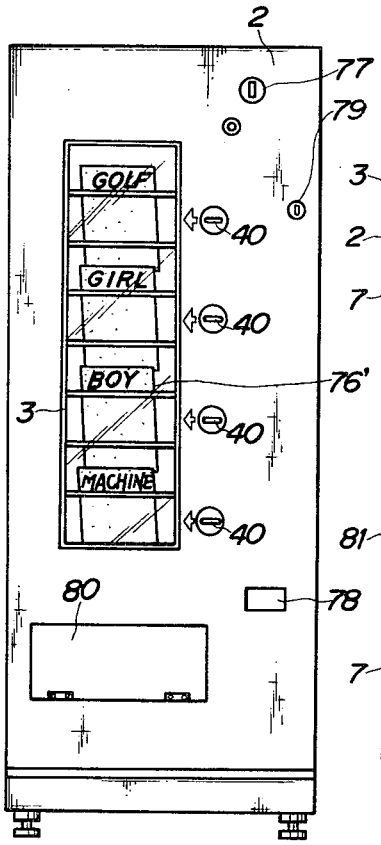
FIG. 1 is an overall front view of the machine made in accordance with this invention.

Now, with reference to the drawings, housing 1 is a cubic box having an elongated height, and its upper and bottom walls and side walls are all made of thin steel plates. Its front is open at 23, and there is fitted to said opening 23 a door 2. Said door has an oblong and transparent show-window 3 extending adjacently to and in parallel with a longitudinal central line thereof, and also has a small window 80 which is for taking out a magazine and is located just below the show-window.

In FIG. 1, there are illustrated a coin charging slot 77, a key slit 79, a change discharging slot 78, and a group of sample magazines 78''.

Manual levers 40 are provided one each to the sample magazines and just aside thereto.

Figure 2:
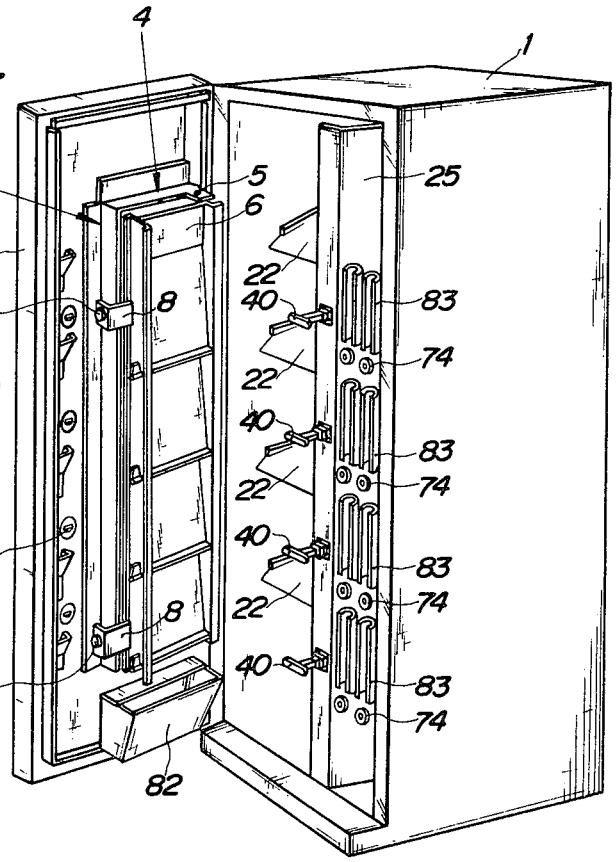
FIG. 2 is an perspective view of the machine with its front cover plate partly opened.

In FIG. 2 in which the door is halfly opened, it is shown that a rear side of the show window 3 projects in the form of a frame and constitutes an extended edge 4. To this edge 4, there fitted shelves 6 by means of a shaft pin 5, so that the shelves can be opened and closed about the pin for accomodating thereon sample magazines. Numeral 8 indicates L-shaped metal fixtures which retain the shelves to the frame on edge 4. A fastening screw 7 is fitted to each of the metal fixtures 8.

Just below the said shelves 6, there is provided a receptacle 83 for sample magazines 76' and other magazines 76. Numeral 81 are slit openings through which the manual levers 40 project outwardly when the door 2 is closed. A vertically extending panel 25 is for fixing operating mechanism within the housing. Numerals 83 are tubes for retaining changes, and 74 eccentric polygonal guide wheels for changes.

Figure 3:
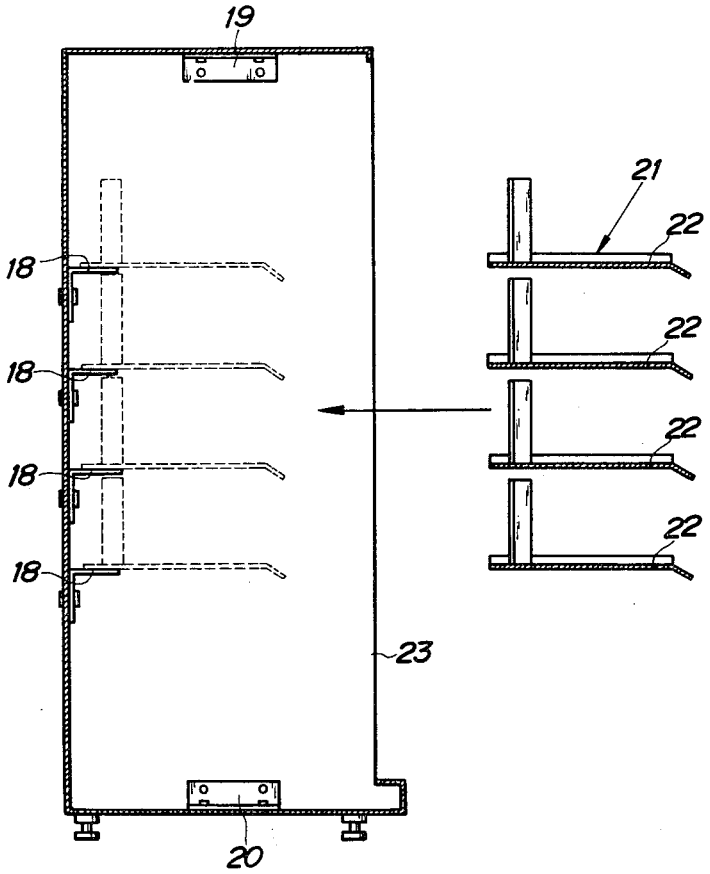
FIG. 3 is a sectional view of an outer housing to which shelves are going to be fitted.

Cantilevers 18 are provided with predetermined distances therebetween to the rear inner side of the housing, as shown in FIG. 3. Upon these cantilevers, there are mounted shelves 21 for stacking thereon magazines for sale. These shelves are constituted from a number of plates 22 which are insertedly fitted on the cantilevers, as indicated by an arrow in FIG. 3. By such constructions, the shelves can be assembled to the housing in the sites where the housing is to be installed. L-shaped fixtures 19, 20 are fitted to the upper and lower side wall of the housing.

Figure 4:
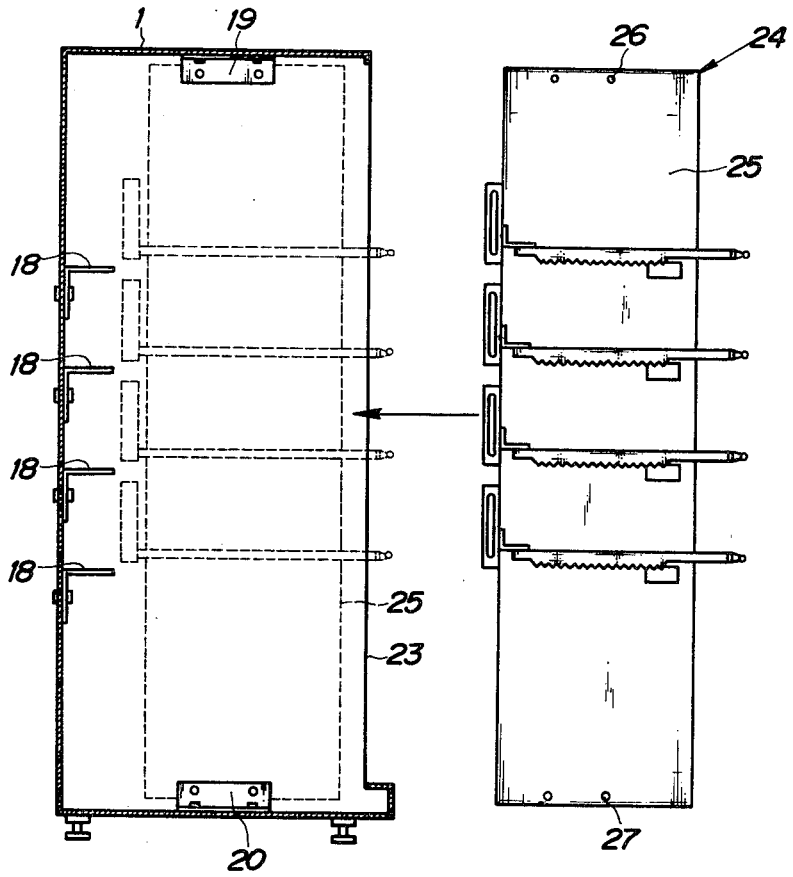
FIG. 4 is a view similar to FIG. 3, in which there is illustrated how main mechanical parts are installed within the housing.

As the length of the aforementioned panel 25 corresponds to the distance between the two L-shaped fixtures 19, 20, the panel 25 can easily be fixed to the fixtures by means of a bolt holes 26 and 27 each provided to the panel. Thus, as best shown in FIG. 4, the panel 25 integrally fitted with a magazine releasing mechanisms 24 can be introduced into the housing through its front opening 23 and be fixedly mounted therein.

Figure 5:
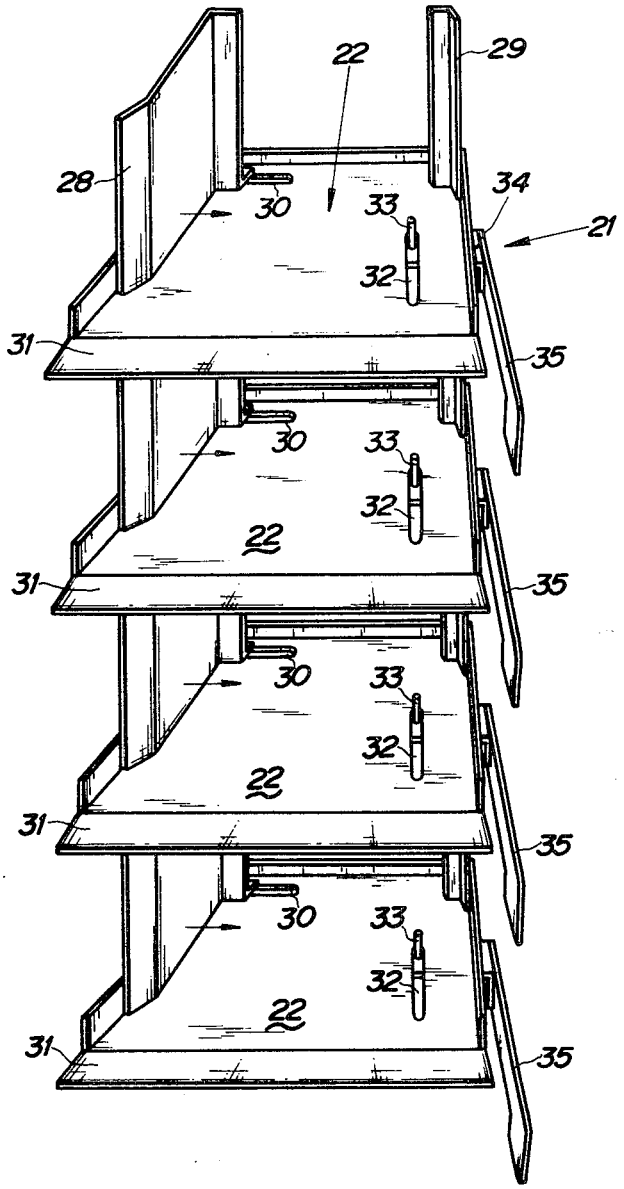
FIG. 5 is a perspective view of the shelves.
Figure 6:
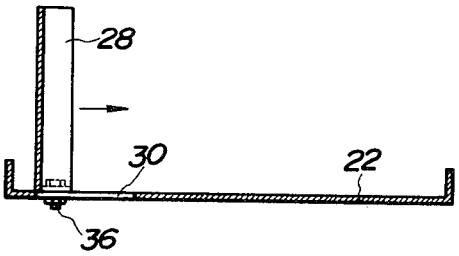
FIG. 6 is a view taken along the line VI—VI in FIG. 7.
Figure 7:
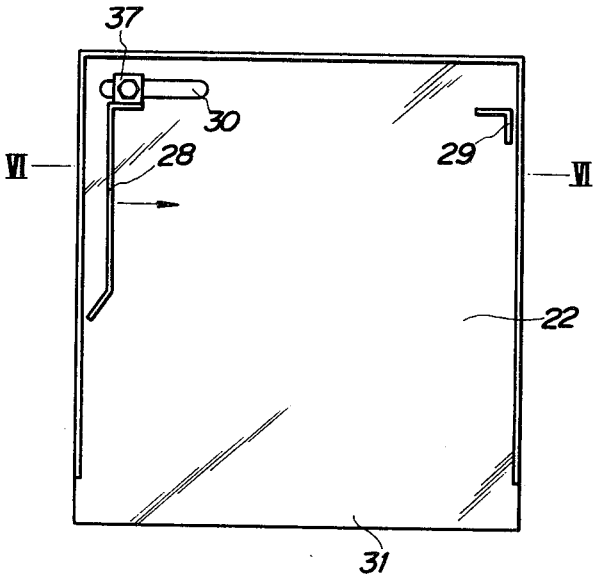
FIG. 7 is a plan view of one of the shelves.
Figure 9:
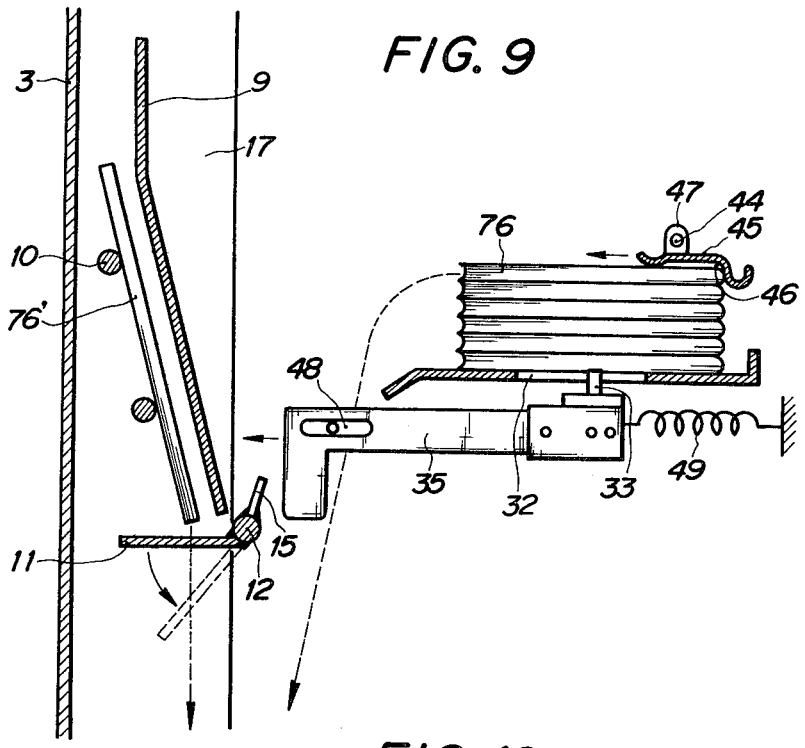
FIG. 9 is a vertical sectional view of said lever mechanisms.
Figure 10:
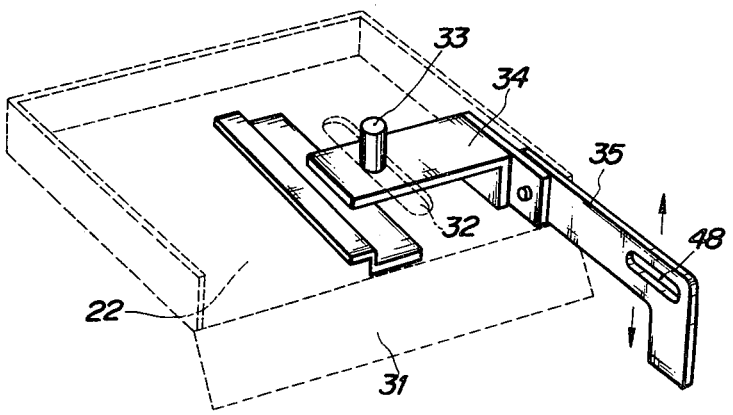
FIG. 10 is a perspective view of lever mechanisms for releasing a magazine displayed at a show-window as a sample.
Figure 12:
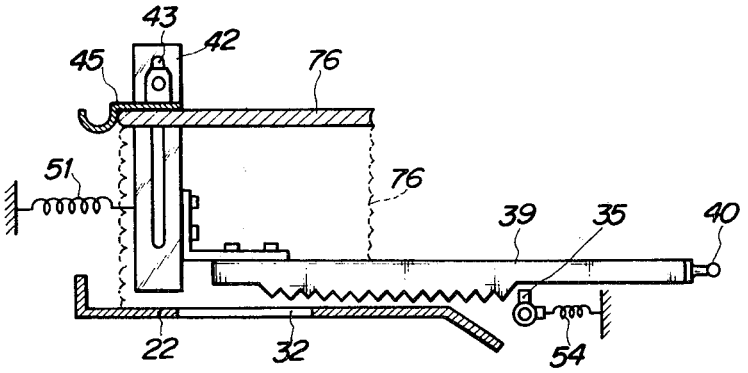
FIG. 12 is a partly sectional side view illustrating ratchet mechanisms of an operating lever.

As shown in FIGS. 5 to 7, the number of shelving plates 22 corresponds to the number of kinds of magazines for sale. To each of the plates 22, there is provided a vertically extending plate 28 which is adjustable of its location in accordance with a width of a magazine for sale. Said plate 28 is, more specifically, movable along a slot 30 and fixable at any desired position by means of a bolt 36. At a side opposite to said plate 28, there is provided a stationary corner plate 29. And, to each of the shelving plates 22, there is provided a slot 32 which extends transversely to the aforementioned slot 30, through which a pin 33 projects outwardly. This pin 33 is fixed to a plate 34 (FIG. 10), and to this plate 34 there is fitted a rod 35 (FIGS. 10 and 9). It is preferable to make said pin 33 descendable by the gravity of magazines mounted thereupon. Numeral 37 in FIG. 7 indicates a bent for supporting the bolt 36, and numeral 31 a slope for releasing the magazine 76.

With reference to FIG. 8, mechanisms for releasing magazines shall be explained hereinunder. Vending machines of this kind are generally operable only when an adequate amount of coins is given into the machines, since lock releasing mechanisms operable by coins are provided to the machines. Such lock releasing mechanisms shall not be explained here in detail, because they are most conventional.

Figure 13:
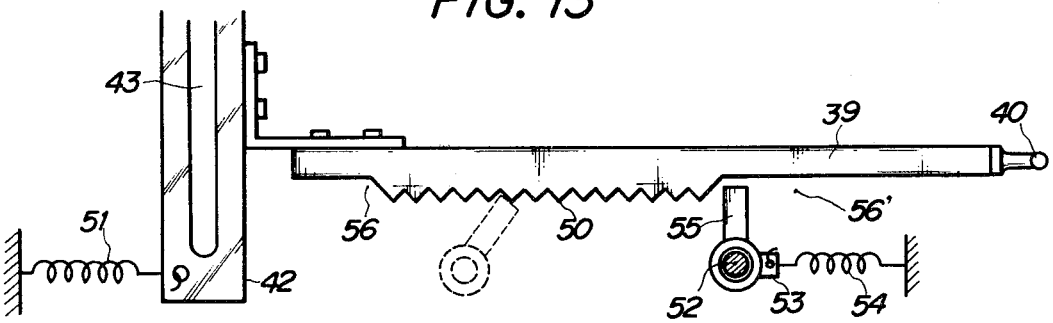
FIG. 13 is an enlarged view similar to FIG. 12 before the lever is operated.

The manually operated lever 40 which is illustrated in FIG. 8 is also active only when a certain amount of coins are given into the housing. As described hereinbefore, a lever 39 connected to the manual lever 40 and projected outwardly through the opening 84 of the panel 25 is withdrawable manually by a customer towards him against a spring 51 which biases said lever 39 oppositely to the customer (FIG. 13). A vertically extending U-shaped steel piece 42 is fitted to the end of said lever 39 through an intermediate metal fixture 41. The said U-shaped steel piece 42 has a slit opening 43 which extends vertically, to which opening 43 a horizontally extending rod 44 engages at its free end which descends by its own gravity. Another end of said rod 44 extends over the shelving plate 22 and rotatably fitted with a pusher plate 45. Numerals 47, 47 are lugs provided at both lateral edges of the pusher plate 45. The said pusher plate is a rectangular shape at its plan view and its rear portion is always kept lowered compared to the level of its front portion. Said rear portion is bent downwardly at a distance 46 which corresponds to a thickness of a magazine. This downwardly bent portion 46 can be made integrally with the pusher plate 45 by bending the said plate, or by welding an independent plate to the pusher plate 45. In order to make it sure that said bending portion 46 does always engage with the rear of the upper mostly stocked magazine on the shelving plate 22, a weight can be fitted adequately to said bending portion 46.

The sample magazine 76' displayed at the show-window is released by means of the aforementioned rod 35. As this rod 35 has a comparatively long length, it is apt to swing. In order to prevent such undesirable swing motion of the operating rod 35, it has a slot 48 adjacently to its forward end, to which slot 48 a pin fitted to a support plate 38 which is in turn fixed to the panel 25.

With reference to FIGS. 9 and 11, mechanisms for releasing sample magazines are explained hereinunder. The shelves 6 are provided at their sides U-shaped vertically extending side plates 17, 17 with a predetermined space therebetween. A backing plate 19 is fitted between the plates 17. This plate 19 is provided with laterally extending retainer rods 10, and at its lower end a rotatable plate 11 which is fixed to a rotatable shaft 12 and kept normally at a horizontal position by means of a spring 13. To a projection end of the shaft 12, there is provided a lug 15 which is engageable with the rod 35 when it moves forward. The engagement of the rod 35 with the lug 15 causes the rotation of the plate 11 as shown by dotted lines in FIG. 9. Numeral 14 in FIG. 11 shows a pin for fixing an end of the spring 13.

Figure 14:
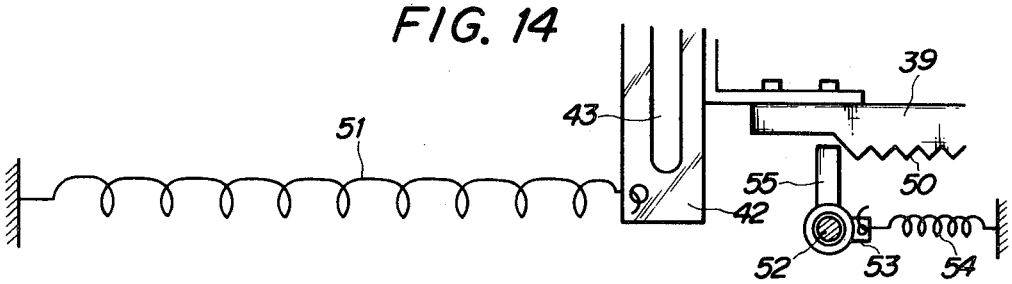
FIG. 14 is a view same to FIG. 13, but the lever is completely operated.

In FIGS. 13 and 14, there is illustrated mechanisms for assuring the return of coins when a magazine is not released on account of the malfunction of the manual operating lever 40. A rack 50 is formed to the lower surface of the lever 39. A projection 55 which is pivoted to an axis 52 and has an integral extension 53, is normally kept to extend upright by means of a spring 54 fitted at one of its ends to the extension 53. Said projection 55 keeps its upright position when it does not engage with the rack 50, while it is inclined when it engages the rack 50. To wit, said projection 55 keeps its upright position on account of a recess 56' before the withdrawal of the lever 39, and keeps also its upright position on account of another recess 56 after the completion of withdrawal of the lever 39. In other words, the said projection 55 is inclined only in course of the withdrawal of the lever 39. The function of said projection 55 will be clear in the latter part of this specification.

Figure 15:
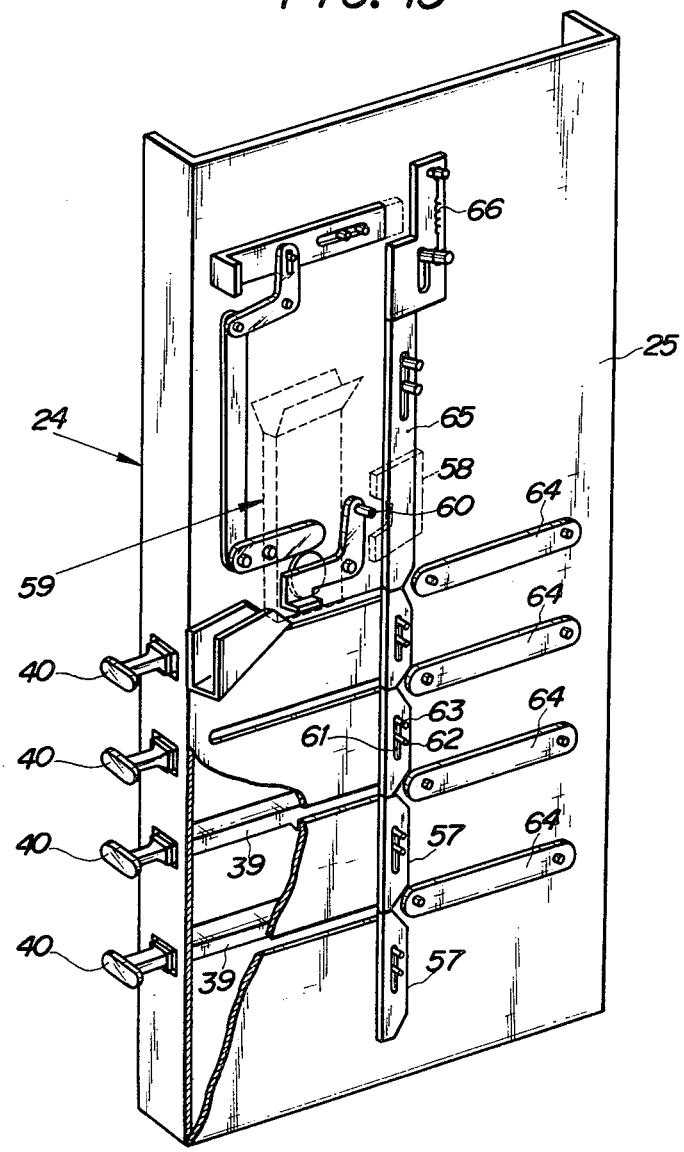
FIG. 15 is a perspective view illustrating a group of the levers provided in the housing.
Figure 16:
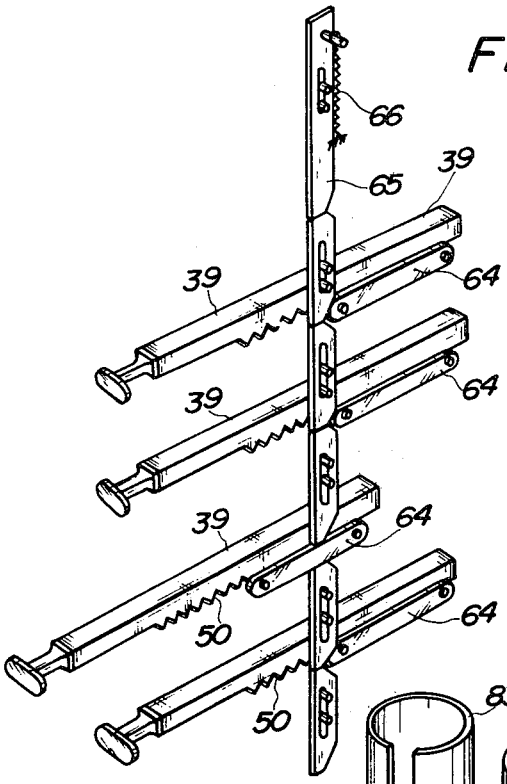
FIG. 16 is a perspective view of said group of levers disassembled from the housing.

In FIGS. 15 and 16, there is illustrated mechanisms for preventing the operation of more than one levers 40 at a time. Aside the operating levers 39, there are provided limit plates 64, 64 which extend along the moving direction of the levers 40. Each limit plates 64 engage at its forward end with a locking plate 57 which is movable only upwardly out not downwardly. A number of said locking plates 57 abut each other and are in alignment vertically with their abutting lines which are coincient with the forwarding direction of each of limit plates 64. As aforementioned, one of the locking plates 57 is lifted upwardly, when one of the limit plates 64 moves towards said locking plate by the withdrawal of one of the manual levers 40, by the sliding movement of a slot 61 along a pin 62. Therefore, when one of the limit plates 64 intervenes between the selected two of locking plates 57, all the remaining locking plates can not slide upwardly as illustrated in FIG. 16, whereby more than one levers 39 cannot be withdrawn at a time.

Figure 17:
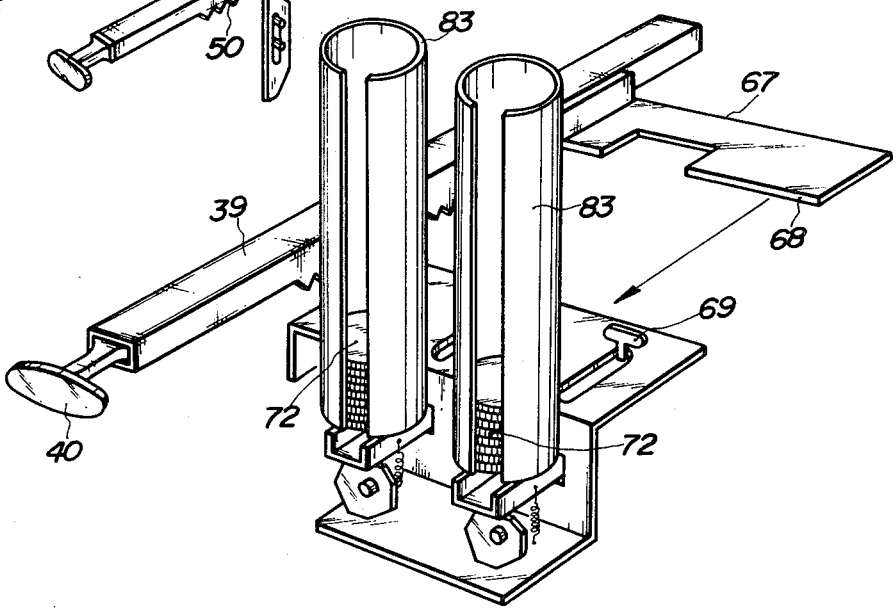
FIG. 17 is a perspective view of mechanisms for lacking changes.
Figure 18:
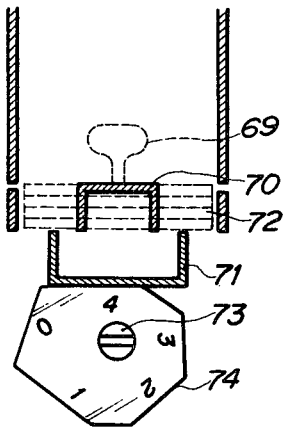
FIG. 18 is a vertical sectional view of a principal part of FIG. 17.
Figure 19:
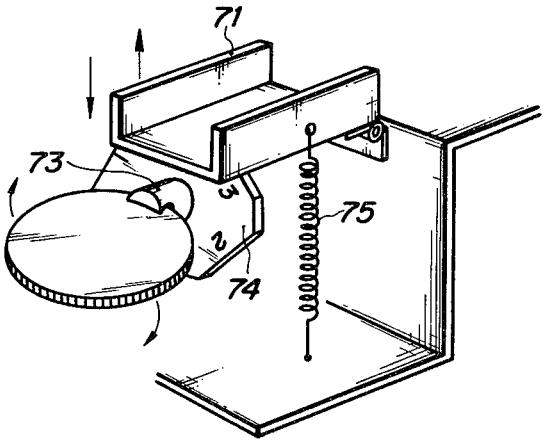
FIG. 19 is a perspective view of means for adjusting changes.

In FIGS. 17 to 19, there is illustrated mechanisms for releasing adequate amount of changes, solely by means of the manual withdrawing of the operating lever 39 and without employing any electrically operated devices. As illustrated in the drawings, to a side of the lever 39, there is fixed a horizontally extending pusher plate 67, forward edge 68 of which is engageable with a lug 69 when the pusher plate moves forward. Said lug 69 is fixed to the upper portion of a pusher 70 which is in turn provided to the lower portion of the change storing tube 83. A trough 71 which is adjustable of its positions vertically by means of the eccentric polygonal dial 74, is provided the change containing tube 83. Said dial 74 is rotatably adjustable of its position about an axis 73, and the trough 71 is biased against said dial 74 by means of a spring 75 so that they always abut each other. In the drawing, particularly in FIG. 15, numeral 58 indicates a conventional locking retainer for making the levers 40 operable when an adequate amount of coins is given, 59 a box for retaining the coins for keeping the retainer 58 free, 65 a vertically movable rod provided above the uppermost locking plate 57, and 66 springs.

Figure 20:
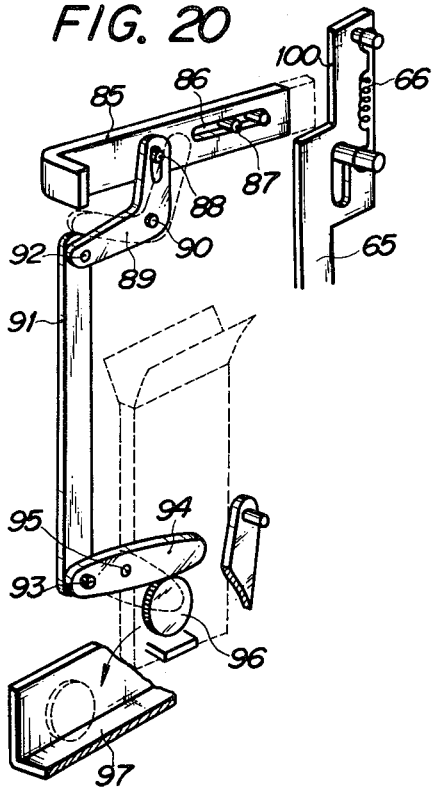
FIG. 20 is a perspective view of mechanisms for returning coins.

In FIG. 20, there is illustrated mechanisms for returning coins. When a customer wishes not to buy a magazine after he has given coins into the machine or when it is found that coins inserted into the box 59 are not sufficient for releasing a magazine from the vending machine, the coins 96 are returnable by the mechanisms.

To wit, the head of a lever 85 projects outwardly from the housing 1 or the door 2, while a slot 86 is provided to a rear part of said lever 85, said slot 86 being slideable along a pin 87 which is fixed to the panel 25 whereby the lever 85 can manually be pushed backwards, as indicated by dotted lines. A L-shaped lever 89 is pivoted at its mid portion by a pin 90 which is fitted to the panel 25. A end of said L-shaped lever is connected to the lever 85 by means of a pivot shaft 88, while another end is pivoted to the upper end of a rod 91 by means of a pivot shaft 92. Another end of the rod 91 is in turn pivoted by a shaft 93 to an operating lever 94 which is turnable about a pin 95 to the position indicated by dotted lines. Numeral 97 indicates a trough for returning the coin 96. When the rear end 98 of the lever 85 is pushed backwards, the rod 65 is locked by said rear end 98 through its engagement with a notch 100 of a connecting plate 99 which is fitted to the rod 65.

The magazine vending machine having the above constructions operate as follows.

When a customer inserts coins into the slot 77, the coins fall down into the receptacle 59, resulting in releasing the locking of the locking pin 60 and thereby making the retaining metal 58 free. Therefore, the withdrawal of one of levers 39 towards the customer makes the corresponding limit plate 64 intervened between the two of the locking plates 57. When the selected one of the levers 39 is further withdrawn, the rack 50 moves forwards, inclining the lug 55 towards the moving direction of the lever 39 (FIG. 13). As said lug 55 can not return to its upright position while it engages the rack 50, the lever 39 can not return to its original position until it is completely withdrawn and becomes upright at the recess 56. With the withdrawal of the lever 39, the pusher 45 also moves forward whereby the bent 46 of the pusher 45 pushes only the uppermost magazine, whereby said magazine is released from the shelf 22 and falls down by its own gravity. The magazine is thus released from the vending machine through the small window 82. The forward movement of the lever 39 also brings about the forward movement of the pusher 67 which simultaneously releases an adequate amount of changes.

When the magazines 76 stocked upon the shelf 22 are exhausted, the pin 33 engages the pusher plate 45, resulting in pushing said pin forward and consequently in the forward movement of the rod 35 against the spring 49. The forwardly moved rod 35 abuts against the lever 15 (FIG. 9), whereby said lever 15 rotates counterclockwise and a sample magazine mounted on the plate 11 falls down into the small window. The front surface of the plate 9 with the indication of "sold out" then appears.

As thus described this invention in the above, the magazine vending machine made in accordance with this invention can positively attain all the objects enumerated in the preamble of the specification.

What is claimed is:

1. A magazine vending machine which comprises:

a housing box having a front opening which is closed by a door provided with show-window means;

a first plurality of shelves provided on said door for displaying respective magazines through said show-window means, each said shelf of said first plurality of shelves having a respective bottom sheet movable from a horizontal level to a downwardly inclined position;

a second plurality of shelves provided within said housing box for stocking thereupon magazines in respective piles, each said shelf of said second plurality of shelves being provided with a respective pusher means which releases magazines one by one upon operation of the vending machine and also provided with respective sensing means which is operable to actuate a corresponding one of said pusher means for bringing a said bottom sheet to the inclined position upon exhaustion of magazines stocked on a corresponding shelf of said second plurality of shelves;

lever means projecting outwardly of said box, said lever means comprising a plurality of levers, each of said levers being operatively connected with a respective one of said pusher means and being manually operable upon the insertion of coins from its retracted position to its withdrawal position, means for preventing operation of more than one of said levers at a time, said means for preventing including respective limit plates which extend along a direction of movement of said levers and are movable therewith, respective movable locking plates which engage with an end of respective said limit plates, said locking plates being positioned in abutment with adjacent ones of said locking plates in substantial vertical alignment with their lines of abutment coincident with points of contact with respective said limit plates, whereby upon movement of one of said limit plates between adjacent ones of said locking plates by action of one of said levers moves all of said locking plates in a vertical direction placing points of contact of remaining ones of said limit plates with said locking plates away from said lines of abutment; and means for releasing change operative solely by each said lever, said means for releasing including a respective pusher plate fixed to and movable with each said lever, a respective lug engageble with each said pusher plate when said pusher plate moves forward, each said lug being fixed to an upper portion of a respective pusher which in turn is positioned in a lower portion of a change storing tube, a trough adjustable by a polygonal dial, said dial being rotatably adjustable of its position about an axis, and said trough being biased against said dial by resilient means.

2. A magazine vending machine which comprises:

a housing box having a front opening which is closed by a door provided with show-window means;

a first plurality of shelves provided on said door for displaying respective magazines througb said show-window means, each said shelf of said first plurality of shelves having a respective bottom sheet movable from a horizontal level to a downwardly inclined position;

a second plurality of shelves provided within said housing box for stocking thereupon magazines in respective piles, each said shelf of said second plurality of shelves being provided with a respective pusher means which release magazines one by one upon operation of the vending machine and also provided with respective sensing means which is operable to actuate a corresponding one of said pusher means for bringing a said bottom sheet to the inclined position upon exhaustion of magazines stocked on a corresponding shelf of said second plurality of shelves;

lever means projecting outwardly of said box, said lever means comprising a plurality of levers, each of said levers being operatively connected with a respective one of said pusher means and being manually operable upon the insertion of coins from its retracted position to its withdrawal position;

means for preventing operation of more than one of said levers at a time, said means for preventing including respective limit plates which extend along a direction of movement of said levers and are movable therewith, respective movable locking plates which engage with an end of respective said limit plates, said locking plates being positioned in abutment with adjacent ones of said locking plates in substantial vertical alignment with their lines of abutment coincident with points of contact with respective said limit plates, whereby upon movement of one of said limit plates between adjacent ones of said locking plates by action of one of said levers moves all of said locking plates in a vertical direction placing points of contact of remaining ones of said limit plates with said locking plates away from said lines of abutment; and change release mechanism means independent of said magazine releasing means and including force-receiving means, said panel having a number of slots therein corresponding in number to said lever means, a respective pusher plate extending through each said slot and coupled to respective said levers and movable therewith, and said force-receiving means being positioned for movement upon contact with said pusher plates to deliver change upon actuation of one of another of said levers.

* * * * *